US006796873B1

(12) United States Patent
Tsao

(10) Patent No.: US 6,796,873 B1
(45) Date of Patent: Sep. 28, 2004

(54) STRUCTURE OF A TOY CAR

(76) Inventor: Chi Ping Tsao, PO Box 82-144, Taipei (TW)

( * ) Notice: Subject to any disclaimer, the term of this patent is extended or adjusted under 35 U.S.C. 154(b) by 0 days.

(21) Appl. No.: 10/716,503

(22) Filed: Nov. 20, 2003

(30) Foreign Application Priority Data

Dec. 4, 2002 (TW) ..... 91219620 U

(51) Int. Cl.[7] ..... A63H 17/00
(52) U.S. Cl. ..... 446/436; 446/444; 446/455
(58) Field of Search ..... 446/175, 436, 446/438, 439, 441, 442, 443, 444, 455, 457, 460, 484

(56) References Cited

U.S. PATENT DOCUMENTS 3,600,851 A * 8/1971 Nielsen ..... 446/436
4,658,928 A * 4/1987 Seo ..... 180/168
4,735,593 A * 4/1988 Lin ..... 446/436
4,828,525 A * 5/1989 Okano ..... 446/175

* cited by examiner

*Primary Examiner*—Jacob K. Ackun, Jr.
(74) *Attorney, Agent, or Firm*—Leong C. Lei

(57) ABSTRACT

A toy car is disclosed. The toy car comprises a circuit testing board, a power source device and a toy-car body with a driving mechanism. The circuit testing board and the power source device are detachably mounted onto the toy car body. The circuit testing board enables the terminals of wire cords to be connected, and the circuit testing board is mounted with electronic components and sensing control elements such as sound, thermals and light sensors to form a control circuit by the user, allowing the toy car to be controlled by various kinds of methods to move forward or to turn in direction.

4 Claims, 7 Drawing Sheets

STRUCTURE OF A TOY CAR

BACKGROUND OF THE INVENTION (a) Technical Field of the Invention

The present invention relates to a toy car structure, and in particular, a toy car having a circuit testing board containing a various types of electronic components or various types of sensing control sensors.

(b) Description of the Prior Art

Taiwanese Patent No. 81211519, entitled "Fully-Auto-drive Toy Car", and No. 84213601, entitled "Photo-sensing Electrical Toy Car" disclose complicated toy car structure and can only have a single control mode. Generally, a wireless controller is used to control the forward/backward and direction turning of the toy car as various sensing control elements cannot be mounted to the toy car. Additionally, the circuit and the wires of the toy car are all fixed and cannot be altered. Therefore, other types of sensing control element cannot be added to the toy car and the toy car does not have other way of controlling. In view of the above drawback, based on number of years of design exploitation and research, the inventor has developed a toy car structure, which overcomes all the drawbacks mentioned above.

SUMMARY OF THE INVENTION

It is an aspect of the present invention to provide an electronic toy car comprising a circuit test board, a power source device and a toy-car body, wherein the surface of the circuit test board is provided with a plurality of beehive-shape insertion holes, the power source device includes a battery seat with extension cord, and the toy-car body contains motors and driving mechanisms, and the motor is extended with cord, the transmission energy from the driving mechanism drives the wheels of the car body to rotate, characterized in that the battery seat and the motor are provided with a terminal, and the circuit test board and the power source device are mounted on the toy car body and the insertion holes are for the holding of the terminal of the cord of the motors and the power source device, together with electronic components and sensing control element, a control circuit is formed to provide controlling of the toy car to move forward or turning.

An object of the present invention is to provide a toy car structure containing a circuit testing board, which can hold various type of electronic components and various sensing control element such that it provides more fun to the user by allowing the user to change the ways of remote controlling of the toy car.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
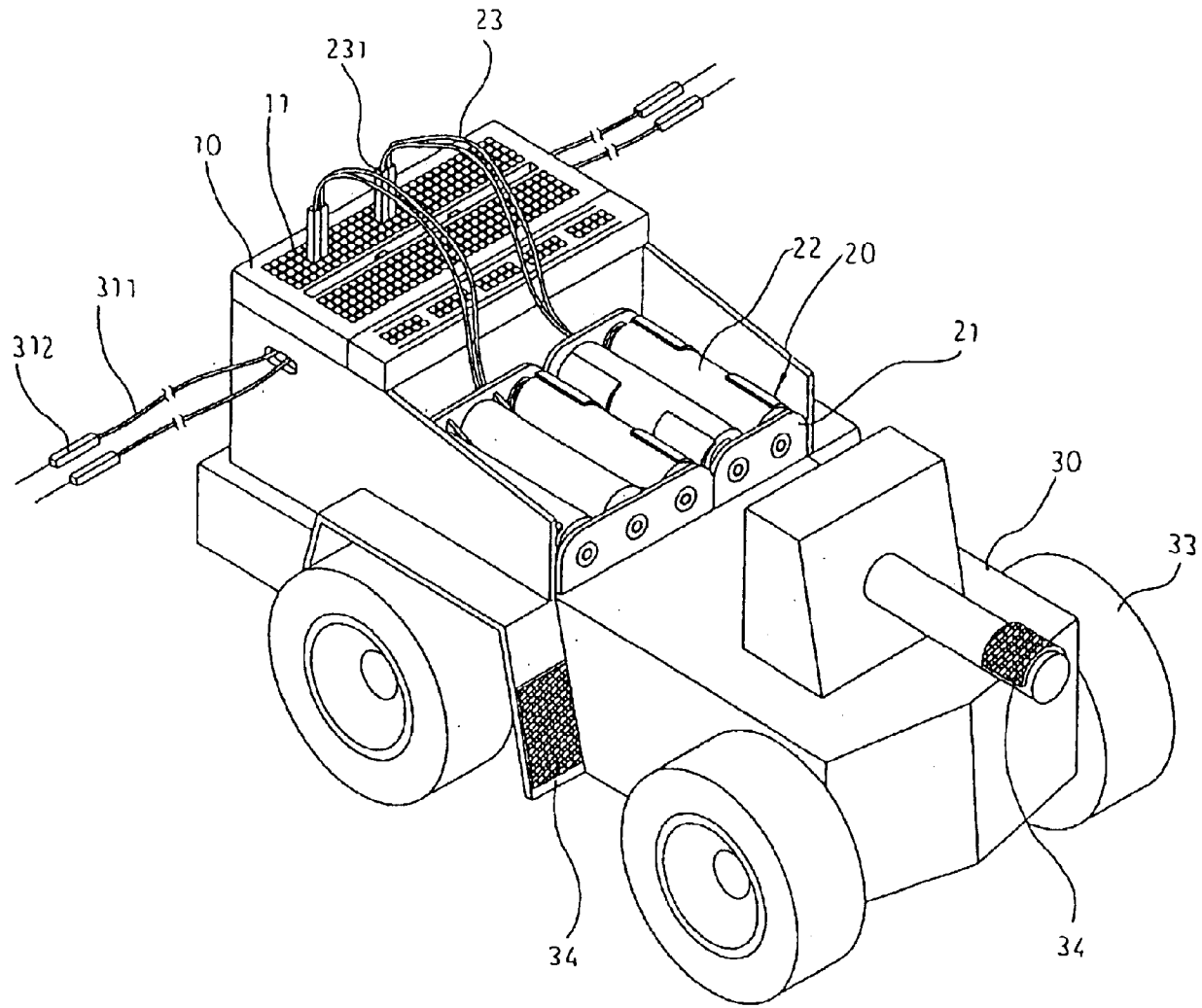
FIG. 1 is a perspective view of the present invention.
Figure 2:
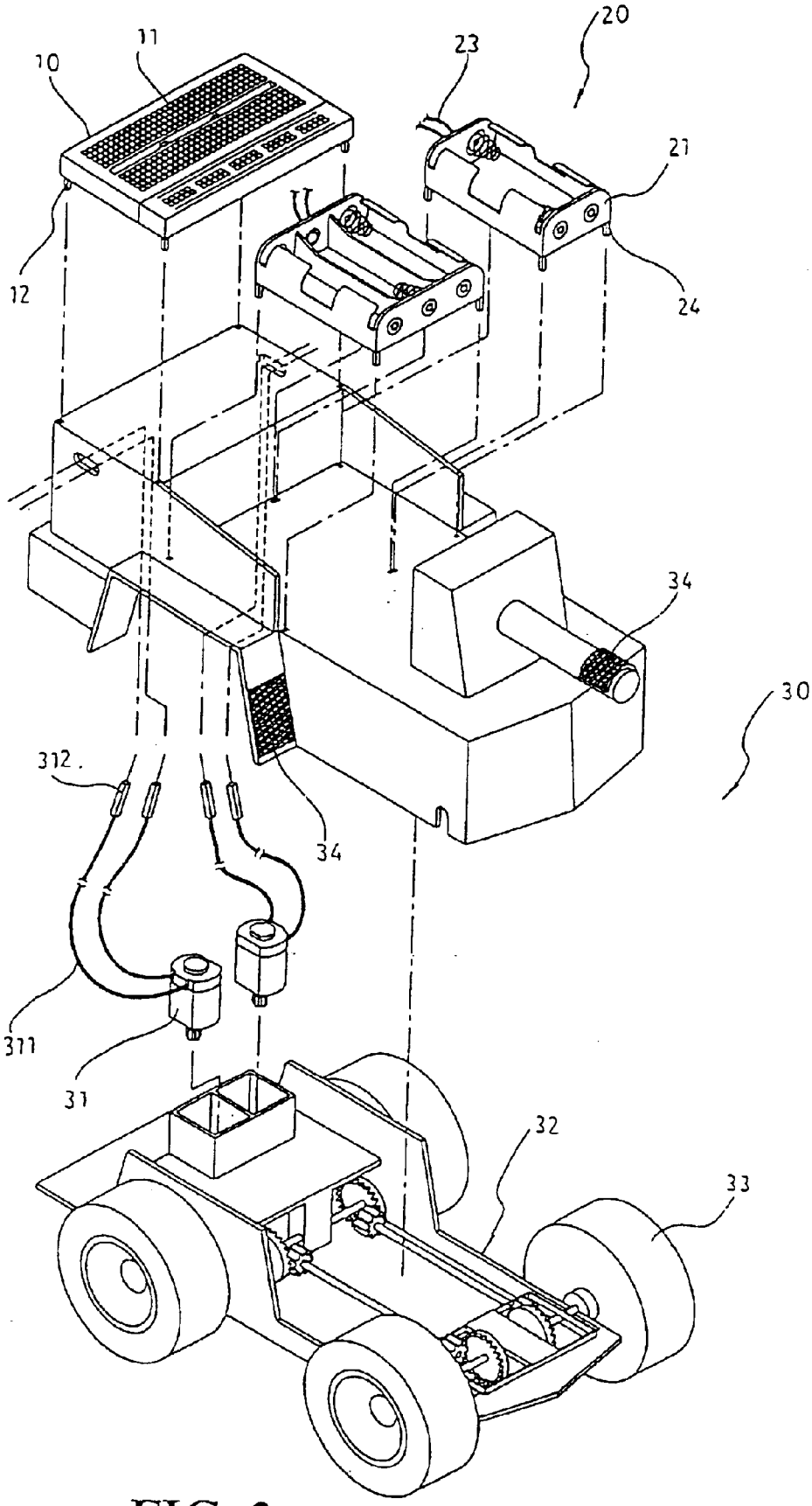
FIG. 2 is a perspective exploded view of the present invention.

Referring to FIGS. 1, and 2, there is shown a toy car structure in accordance with the present invention comprising a circuit testing board 10, a power source device 20 and a toy car body 30 containing a driving mechanism.

The surface of the circuit testing board 10 (for example, the structure of which is similar to bread board) contains a plurality of bee hives insertion holes 11 for mounting with various types of electronic components and various types of sensing control elements (for instance sound, thermal and light sensor, etc). The bottom section of the circuit testing board 10 is provided with an engaging protrusion 12 for the mounting of the board 10 onto the toy car body 30. Thus, this structure enables the circuit testing board 10 to be unloaded for maintenance The power source device 20 contains a battery seat 21, which holds the batteries 22. One side of the battery seat 21 is extended with a plurality of connection wires 23. The end section of the connection wire 23 is terminals 231 for mounting the circuit testing board 10. The bottom section of the seat 21 is provided with an engaging protrusion 24 for mounting the seat 21 onto the toy car body 30. Thus, the power source device 20 can be unloaded for replacement or maintenance.

The interior of the toy car body 30 contains two motors 31 which is extended with a plurality of wires 311. The end section of the wires 311 is connected with terminals 312 for insertion onto the circuit testing board 10. A gear module is employed in the two motors 31 to form into the driving mechanism 32, which are used to respectively drive the wheels 33 at the left and right side of the toy car body. The front or the side of the car body 30 are provided with VELCRO fastener 34 for fastening the sensing control elements.

Figure 3:
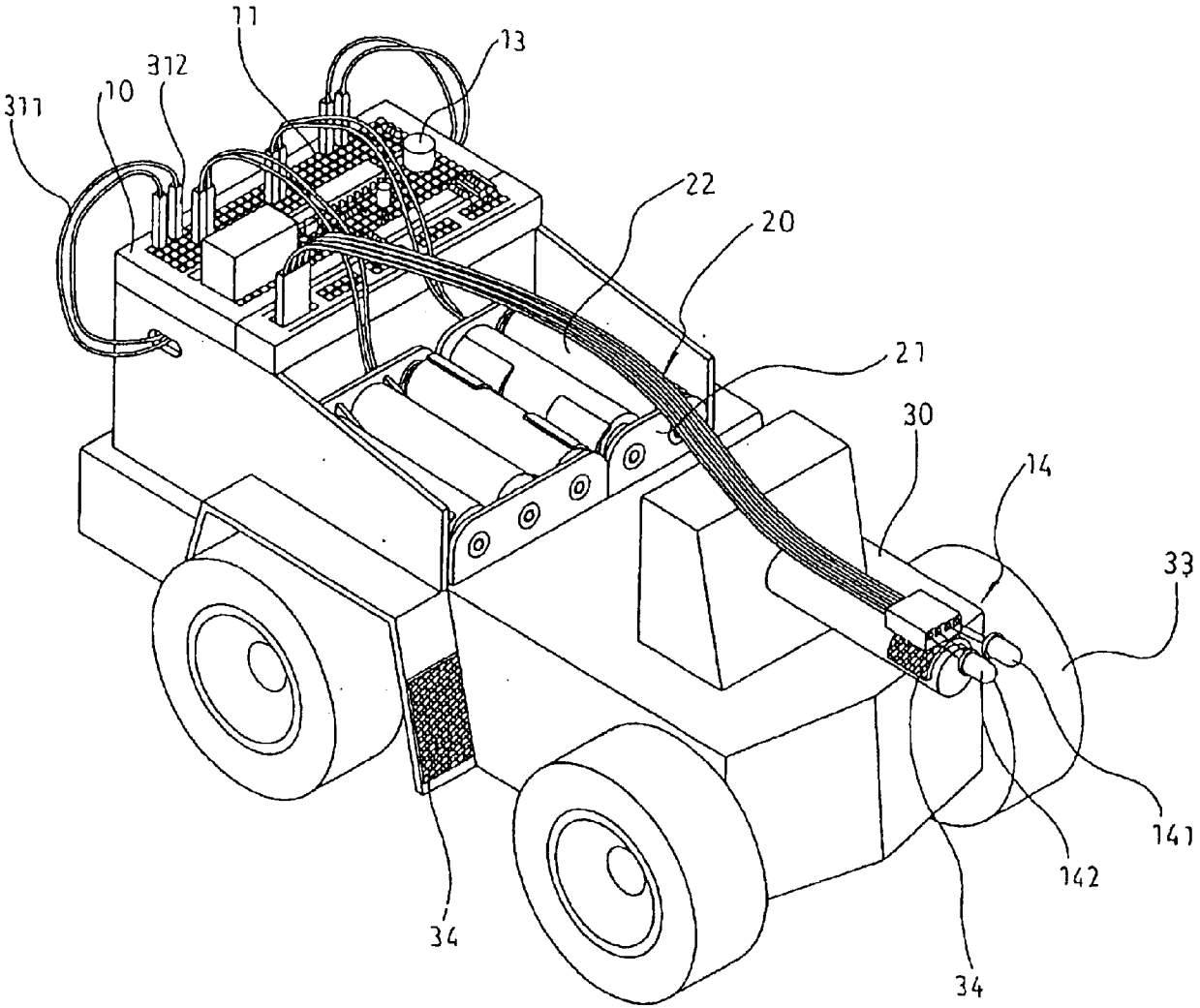
FIG. 3 is a perspective view of the circuit testing board mounted with various types of electronic components and the sensing control element.

Referring to FIG. 3, when in application, the terminals 312 of the wires of the motor 31 and the terminals 231 of the wires of the power source device 20 are mounted onto the circuit testing board 10, and together with the combination of the electronic components (such as relay, resistance, capacitors, etc) and the various sensing control element (sound, thermal, light sensors, etc) mounted on the circuit testing board 10 by the user. In the figure, the sound sensor includes microphone 13, and the light sensor is infra-red sensor 14. The structure also includes infra-red emitter 141 and infra-red receiver 142. The infrared sensor 14 can be mounted onto the car body 30 and fastened with a VELCRO 34.

Figure 4:
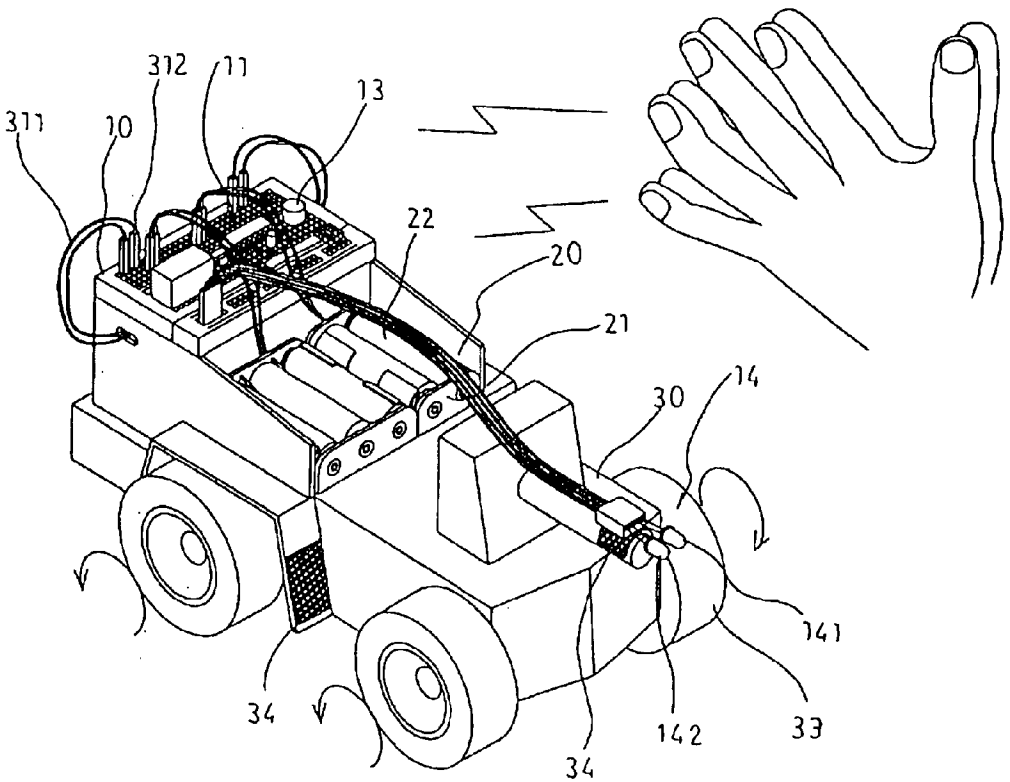
FIG. 4, 4A are preferred embodiments using a sound controlling element in the toy car in accordance with the present invention.
Figure 4A:
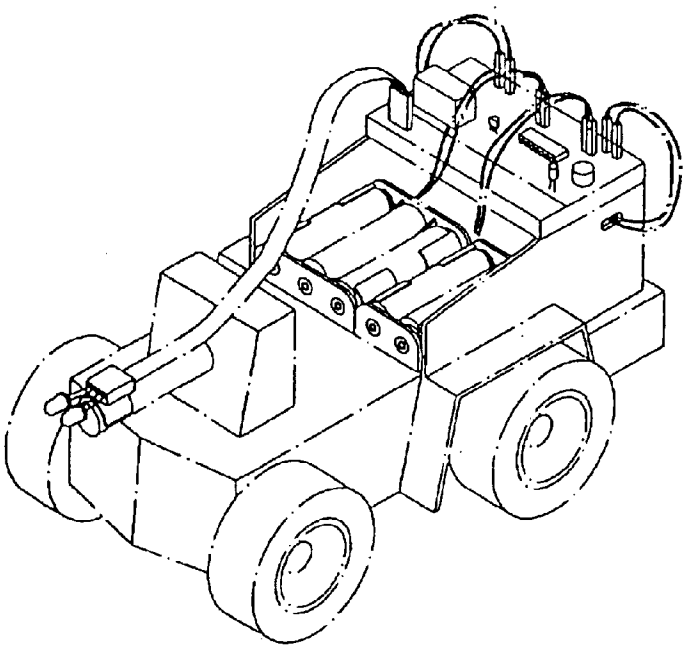

To move the toy car body 30 forward, a sound is made by clapping the hands (as shown in FIG. 4), the microphone 13 on the circuit testing board 10 receives the sound signal and the circuit on the board 10 which triggers the driving of the car body so that the wheel 33 at one side of the body 30 to react within a period of time, and another wheel 33 at the other side of the car body 30 moves forward (as shown in FIG. 4A). Thus, the toy car body 30 provides a rotating movement.

Figure 5:
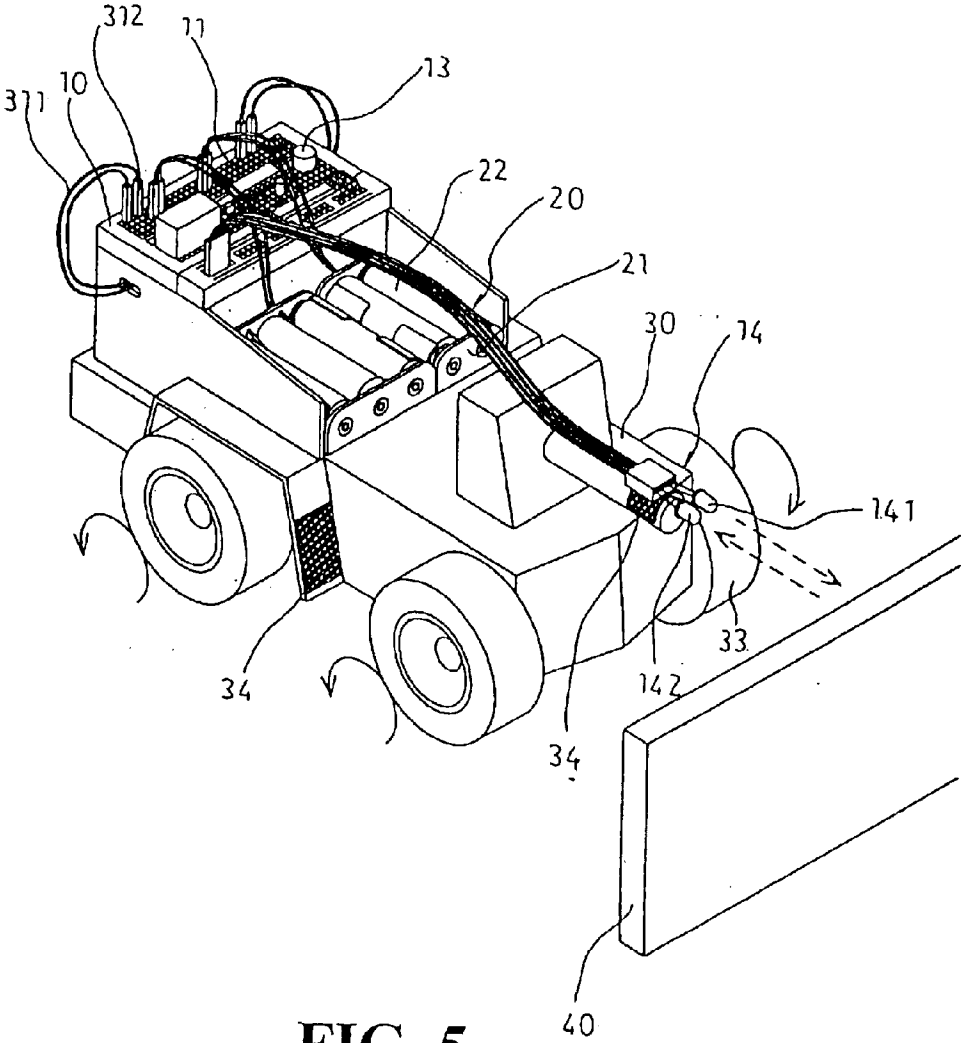
FIG. 5, 5A are preferred embodiments using an infrared sensing control element in the toy car in accordance with the present invention.
Figure 5A:
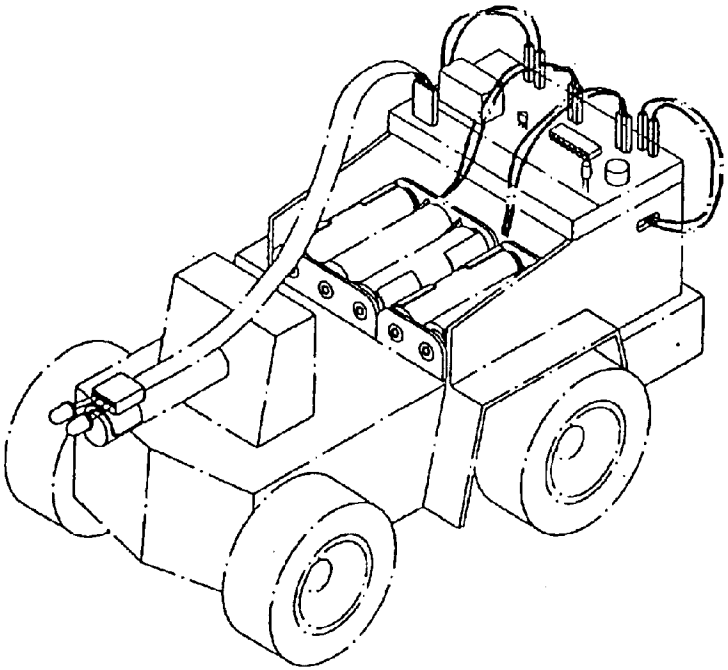

When the toy car body 30 moves forward, if there is an obstacle 40 such as a wall (referring to FIG. 5 and 5A), the infrared sensor 14 at the front of the car body 30 will emit a signal and the signal is reflected. The infrared sensor 14 senses the reflected signal, the circuit for triggering the car body on the circuit testing board 10 is initiated such that the wheel 33 at one side of the car body 30 will rotate reversely at a prescribed time and the other wheel at the other side of the car body will continue to move forward, and the toy car body 30 provides a turning action.

Figure 6:
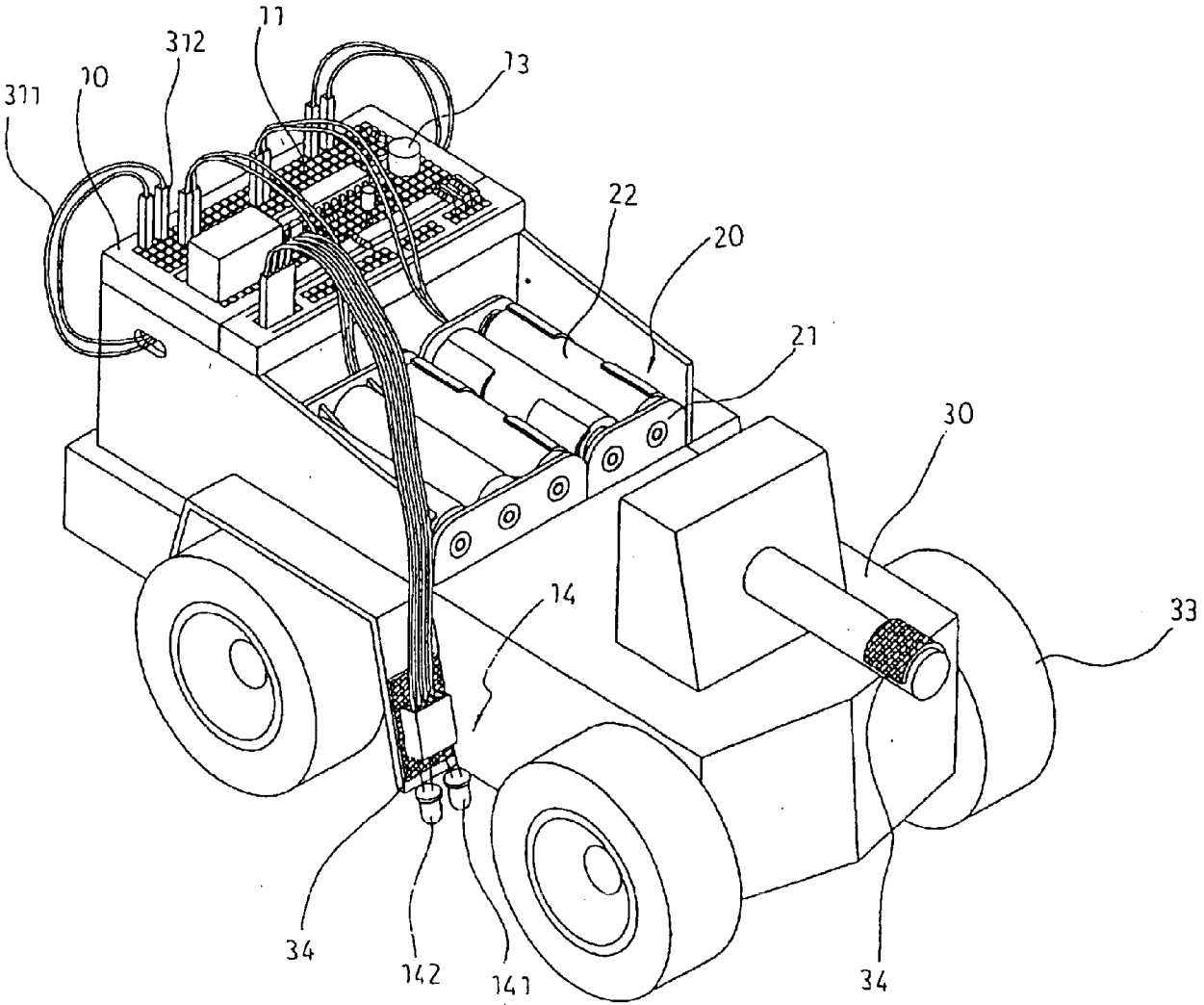
FIG. 6 is a perspective view from the side of the toy car body mounted with infrared sensor shown in FIG. 3 of the present invention.
Figure 7:
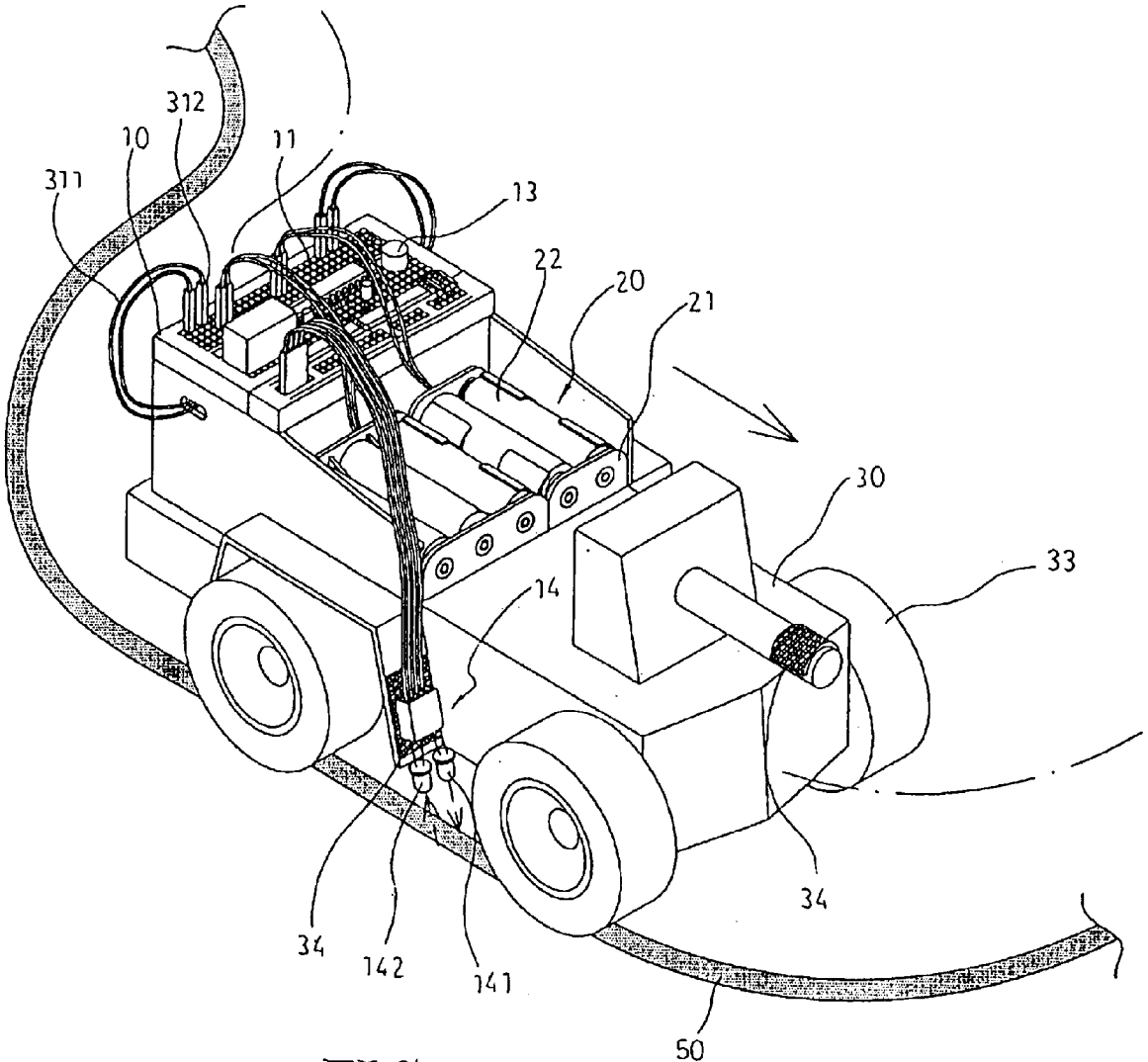
FIG. 7 is a schematic view showing the structure of FIG. 6 moving along the black color rail in accordance with the present invention.

Additionally, the infrared sensor 14 can be mounted to the VELCRO fastener 34 at the side of the car body 30, as shown in FIG. 6), such that the car body can move along the black color rail 50 forward, as shown in FIG. 7.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electronic toy car comprising a circuit test board, a power source device and a toy-car body, wherein the surface of the circuit test board is provided with a plurality of beehive-shape insertion holes, the power source device includes a battery seat with extension cord, and the toy-car body contains motors and driving mechanisms, and the motors are extended with cord, the transmission energy from the driving mechanism drives wheels of the car body to rotate, characterized in that the cords of the battery seat and the motors are provided with terminals, and the circuit test board and the power source device are mounted on the toy car body and the insertion holes are for the holding of the terminals of the cords of the motors and the power source device, together with electronic components and sensing control elements inserted in the circuit test board by an user, and a control circuit is formed by the user to provide various ways of controlling of the toy car to move forward or turning.

2. The electronic toy car of clam 1, wherein the lower section of the power source device, and the circuit testing board are provided with engaging protrusion for engaging to the toy car body, facilitating dismantling and maintenance.

3. The electronic toy car of claim 1, wherein the sensing control elements include sound sensor, thermal sensor and light sensor.

4. The electronic toy car of claim 1, wherein the front section or the side section of the car body is provided with a VELCRO fastener for holding the sensing control elements.

* * * * *